United States Patent [19]

Witte

[11] Patent Number: 4,904,352

[45] Date of Patent: Feb. 27, 1990

[54] ELECTRODEPOSITED MULTILAYER COATING FOR TITANIUM

[75] Inventor: Erwin C. Witte, Placentia, Calif.

[73] Assignee: Microdot Inc., Darien, Conn.

[21] Appl. No.: 143,814

[22] Filed: Jan. 13, 1988

[51] Int. Cl.[4] ..... C25D 5/38; C25D 5/10

[52] U.S. Cl. ..... 204/32.1; 204/29; 204/37.1; 204/38.1; 204/40

[58] Field of Search ..... 204/40, 37.1, 32.1, 204/29, 38.1

[56] References Cited

U.S. PATENT DOCUMENTS

| | | | |
|---|---|---|---|
| 3,647,647 | 3/1972 | Winfree | 204/32.1 |
| 4,092,224 | 5/1978 | Eriksson et al. | 204/32.1 |
| 4,246,324 | 1/1981 | de Nora et al. | 429/17 |
| 4,530,742 | 7/1985 | Carlin et al. | 204/95 |
| 4,589,969 | 5/1986 | Yurkov et al. | 204/290 F |

OTHER PUBLICATIONS

F. A. Lowenheim, Electroplating, McGraw-Hill Book Co., New York, 1978, pp. 59, 171-182, 224.

*Primary Examiner*—John F. Niebling
*Assistant Examiner*—William T. Leader
*Attorney, Agent, or Firm*—Lyman R. Lyon

[57] ABSTRACT

A process for the electrodeposition of a multilayered coating on an article formed of titanium or titanium alloy comprises the steps of: (i) cleaning the article by conventional means, such as by descaling, dry blasing, soaking, and rinsing, so as to remove oxides and other surface contaminants therefrom and expose the article's titanium substrate; (ii) immmersing the clean article in an agitated acid bath at room temperature to activate the surface thereof; (iii) immersing the thus activated article in an agitated aqueous nickel bath preferably comprising nickel chloride at room temperature and cathodically applying a relatively thin non-porous nickel base coat directly on the exposed titanium substrate to improve subsequent zinc adhesion thereto; and (iv) immersing the nickel-plated article in an agitated aqueous zinc bath preferably comprising zinc oxide, sodium cyanide, sodium hydroxide and sodium carbonate and electrodepositing a zinc layer of desired thickness over the nickel base coat.

The thus coated titanium article is thereafter preferably baked to provide hydrogen relief therefor. Where a bright surface finish is desired, the article is thereafter dipped for a short period in a brightening solution preferably comprising sodium cyanide. Alternatively, an extra measure of corrosion resistance is obtained, where desired, by supplementary chromate treatment of the article subsequent to the hydrogen relief-baking thereof.

12 Claims, 1 Drawing Sheet

ELECTRODEPOSITED MULTILAYER COATING FOR TITANIUM

BACKGROUND OF THE INVENTION

The instant invention relates to the plating or coating of substrates or articles comprised primarily of titanium.

It is known that a coating on a metallic article may serve to reduce galvanic action between the coated article and another article formed of a less noble metal in the presence of an electrolyte as, for example, where titanium fasteners are employed to secure aluminum aircraft structural components. Specifically, galvanic corrosion occurs when a metal such as titanium, which is passive on the galvanic scale, is placed in direct contact with a relatively less noble second metal such as aluminum, which is thus anodic to titanium. The interposition of a third material between the titanium and the other less noble material, as by coating the titanium article with such third material, thus provides galvanic protection therefor by preventing such direct contact therebetween.

Additionally, a coating can further act as an intermediary to reduce sliding friction between a titanium article and another article, such as may be found where a titanium fastener in the form of a bolt or pin is placed in interference fit in the bore of an aluminum structure, or where a self-locking nut is advanced on a titanium bolt. Specifically, titanium exhibits a molecular affinity towards other metals which is likely to cause galling thereof upon sliding contact therebetween. In aerospace applications, such galling of the aluminum structure may critically affect the fatigue performance thereof. A coating on the titanium fastener comprised of a material having a lesser affinity for aluminum than the titanium substrate thereof provides an improved frictional interface between the titanium substrate of the fastener and the aluminum structure by preventing direct contact therebetween. It is noted that such a coating additionally serves to prevent seizing when utilized with titanium-titanium fastener combinations.

Unfortunately, the tendency of titanium to rapidly oxidize when exposed to air, and the deleterious effects of such oxidation on the adherence of a coating applied thereto, greatly complicates any attempt to provide a titanium substrate with such a coating. As a result, the prior art has focused on three approaches for improving the adherence of a coating on a titanium substrate: (i) the use of protective films, conversion coatings, and specialized surface activation techniques prior to application of the coating (ii) the formation of a specific oxide layer having a greater affinity for the metallic coating superposed thereon: or (iii) the formation of a diffusion layer between the titanium substrate and the coating subsequent to the plating thereof.

Examples of the first approach include the interposition of a thin, more noble metal film deposited from ionized solution, as in U.S. Pat. No. 3,164,448 to Pottberg; the formation of a conversion coating by immersion in a solution of fluorosilicate or fluoroborate, as in U.S. Pat. No. 3,725,217 to Hartshorn, Jr.: the pretreatment of a titanium substrate by forming a chromium conversion coating thereon as in U.S. Pat. No. 2,825,682 to Missel et al.: cathodic activation in a non-aqueous acetic-sulfuric-hydrofluoric acid bath, as in U.S. Pat. No. 3,817,844 to Kendall: and the activation of the titanium substrate for subsequent plating by wet peening, pickling with a fluoridic solution, and soaking in a solution containing chromium, fluorine, and arsenic or antimony, as in U.S. Pat. No. 4,340,620 to Mielsch et al.

Unfortunately, such intermediate films and conversion coatings are extremely thin and provide poor adhesion of a second coating superposed thereon, and the surface-activation techniques have not proved wholly effective in preventing the formation of an oxide layer on the titanium substrate prior to the application of the outer coating thereon.

Examples of the second approach include the forming of a non-porous coating upon a titanium substrate comprising higher oxides of titanium by immersing same in an alkaline electrolyte comprising an aqueous solution of sodium fluoride and a hydroxide of sodium or potassium, as in U S. Pat. No. 2,934,480 to Slomin; and the forming of a porous adhesion-promoting oxide coating on a titanium article by anodizing the article in a chromic-hydrofluoric acid bath, as in U.S. Pat. No. 4,473,446 to Locke et al.

Again, such intermediate oxide layers are extremely thin and provide poor adhesion of a second coating superposed thereon. Additionally, an anodic coating of titanium oxide alone, as taught in the '480 patent, fails to supply sufficient lubricity for applications involving the press-fitting of the thus coated titanium article.

An example of the third approach is taught in U.S. Pat. No. 3,691,029 to Raymond, wherein, subsequent to cleaning and acid activation, a first thin electroplated chromium layer is diffusion bonded at 1600–1900° F. to a titanium substrate, whereafter a second, thicker chromate layer is electrodeposited thereupon.

However, the heat treatment necessary to generate a diffusion layer between the coating and the titanium substrate is likely to result in the degradation of the titanium substrate. Additionally, it is noted that where diffusion is avoided, the stripping of the coating from the titanium substrate for the reworking thereof may be accomplished with substantially less work, as by chemical stripping.

It is noted that attempts have also been made to combine two of the aforementioned approaches, as in U.S. Pat. No. 4,236,940 to Manty et al., which teaches the pretreatment of a titanium substrate to form a chromium conversion coating prior to the electroplating thereupon of a relatively thicker chromium layer, whereafter the coated substrate is heat-treated to obtain some degree of diffusion bonding between the electroplated chromium layer and the chromium conversion coating, and between the chromium conversion coating and the titanium substrate.

Ultimately, the aforementioned approaches of the prior art (i) fail to provide sufficient adhesion of the outer coating to the titanium substrate; (ii) fail to provide sufficient galvanic protection: (iii) fail to provide sufficient outer coating lubricity: and (iv) are characterized by costly, and highly specialized method steps not particularly well suited for high volume processing.

It is noted that, due to the failure of the aforementioned approaches, the prior art has resorted to a coating comprising aluminum powder suspended in a plastic binder, such as the one taught in U.S. Pat. No. 4,359,504 to Troy. When properly applied and baked to a predetermined hardness, the coating improves the frictional interface between a titanium article coated therewith and the other metallic article. Additionally, there is no risk of galvanic corrosion between such an aluminum-pigmented coating and an aluminum article placed in contact therewith.

Unfortunately, however, application of an aluminum-pigmented coating is complex and tedious: the coating is applied mechanically through precision spraying nozzles as the article to be coated is rotated and advanced through a spray station, whereafter the coated article is suspended in an oven in order to cure the plastic binder to its final hardened condition. Moreover, while the rate of deposition of the coating on the shank portion of a fastener is relatively controlled, the thickness of the coating on the threaded portion of a fastener is virtually uncontrolled. Indeed, specifications for such coatings typically do not require thickness measurements to be made on the threaded portion of the fastener. As a result, a large variation in prevailing torque occurs when lock nuts are utilized with threaded fasteners having such a coating, in addition to the increased friction problems encountered due to the abrasivenature of the sliding aluminum-aluminum contact where the nuts are also formed from aluminum. Such variation in prevailing torque has been a continuing problem with aerospace fasteners presently in use.

SUMMARY OF THE INVENTION

It is the purpose of the instant invention to provide a coating for a titanium article which minimizes galvanic action between the titanium article and a second article in contact therewith when in the presence of an electrolyte.

It is also the purpose of the instant invention to provide a coating for a titanium article which will prevent stress corrosion cracking therein.

A further purpose of the instant invention is to provide a coating for a titanium article having a lower molecular affinity for the metal comprising a second article in contact therewith than the titanium substrate thereof.

A further purpose of the instant invention is to provide a method for coating a titanium article with an outer zinc layer, whereby improved adhesion of the zinc layer to the titanium substrate of the article is achieved.

A further purpose of the instant invention is to provide a method for coating a titanium article characterized by precise control of the thickness of the coating produced thereby.

A further purpose of the instant invention is to provide a method for coating a titanium article which is operable predominantly at room temperature and is, as such, only minimally endothermic.

Yet another purpose of the instant invention is to provide a method for coating a titanium article which utilizes readily available, high-volume plating equipment and simplified handling techniques.

The multilayer electrodeposition method of the instant invention for coating a titanium article comprises cathodically applying a nickel strike from a dilute acid bath upon an exposed and acid activated titanium substrate, whereupon a zinc layer of desired thickness is subsequently electrodeposited from aqueous solution. If desired, the outer zinc layer is brightened by dipping the coated article in a suitable brightening solution subsequent to the hydrogen relief baking thereof. Alternatively, additional corrosion protection is achievable with the further application of a chromate conversion coating to the outer zinc layer subsequent to the hydrogen relief bake.

The multilayer coating method of the instant invention provides exceptional adherence of the outer zinc layer by preventing the formation of oxides on the titanium substrate, and the outer zinc layer thus produced provides superior galvanic protection and lubricity. Moreover, the multilayer coating method of the instant invention enjoys a significant cost advantage over the aforementioned prior art processes. For example the electrolytic nickel strike and subsequent electrodeposited zinc layer, as well as the optional brightening dip and chromate conversion coating, may be formed using standard high-volume processing equipment which is readily available through many established plating facilities, thereby obviating the need for specialized processing equipment.

DETAILED DESCRIPTION OF THE PREFERRED EMBODIMENT OF THE INVENTION

Figure 1:
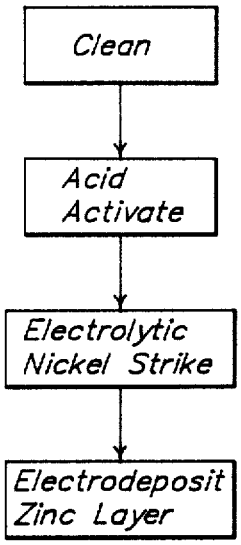
FIG. 1 is a block diagram illustrating the principle steps of the electrodeposition method of the instant invention.

The principle steps of the electrodeposition method of the instant invention as regards the coating of a titanium article are illustrated in block diagram form in FIG. 1. As may be readily seen by reference thereto, the titanium article is initially cleaned by conventional methods so as to remove oxides and surface contaminants therefrom while exposing the titanium substrate thereof. The conventional cleaning methods, known to those skilled in the art, may comprise some or all of the following: degreasing with a suitable solvent, soaking, pickling with acid, treatment with a flux, rinsing, and drying. Additionally, mechanical cleaning treatments such as grit blasting or tumbling may be utilized, where desirable.

After a final rinsing, the cleaned titanium substrate is activated in an agitated acid bath preferably containing hydrochloric acid. For example, the activating bath may comprise HCl (20° Bé) in the range of about 40 to 60 percent by volume at room temperature. It is noted that such a dilute HCl bath provides excellent control of the activation process, in comparison with such stronger acids as hydrofluoric and sulfuric acid, whose speed would otherwise reduce process controllability and uniformity.

After suitable rinsing, the activated titanium substrate is then coated with a thin nickel base coat by means of an electrolytic nickel strike applied from a dilute acid bath at room temperature preferably comprising nickel chloride in the range from about 38 to 42 ounces per gallon of solution (oz/gal.), about 1 to 2 percent by volume of hydrochloric acid, and having no more than 0.3 g/1 of $FE^{3+}$, utilizing a plating grade (99% minimum purity) nickel anode and a cathodic current density of between about 10 and 15 amperes per square foot (a.s.f.), and most preferably between about 11 and 14 a.s.f., at a potential in the range of about 9 to 11 volts D.C.

It is noted that $NiCl_2$ is the most preferred salt for the electrolyte, as it is compatible with HCl. The preferred pH of the nickel strike bath is in the range of about 0.3 to 0.5: a higher concentration of HCl in the bath would increase the conductance of the electrolyte, thereby producing a rough, nodular and, hence, undesirable layer of deposited nickel. Additionally, it is noted that the use of a current density greater than 15 a.s.f. produces a similarly rough and nodular strike.

The resultant nickel strike is preferably held to a maximum thickness of 0.0001 inches.

After rinsing, a zinc layer is electrodeposited on the nickel base coat from an alkaline aqueous zinc bath comprising metallic zinc in the range of about 2.0 to 2.5 oz/gal, about 5.0 to 7.0 oz/gal of plating grade sodium cyanide (96–98% NaCN), about 10 to 12 oz/gal of sodium hydroxide, and between about 2 and 4 ml/gal of an addition agent. It is noted that the level of sodium carbonate within the zinc bath is not to exceed 5 oz/gal, that the bath temperature is not to exceed 100° F., and that the preferred pH range of the bath is between about 13 and 14.

It is crucial that the ratio of cyanide to zinc metal in the bath be maintained in the range of about 2.4 to 2.7, as the efficiency of the zinc plating bath is diminished considerably outside of this range. It is further noted, however, that the metallic zinc may be supplied to the alkaline aqueous electro-plating bath in any form consistent with the other ingredients thereof, such as zinc oxide where a cyanide plating bath is employed.

After a zinc layer of the desired thickness has been electrodeposited over the nickel base coat, the thus coated titanium article is removed from the electroplating bath, rinsed, thoroughly dried, and hydrogen relief baked in a manner familiar to those skilled in the art.

The thus coated titanium article may be post-treated subsequent to the hydrogen relief bake. For example, where a bright surface finish is desired, the thus coated titanium article is thereafter dipped for a short period in a brightening solution having a composition known to those skilled in the art. For example, such a brightening solution may comprise sodium cyanide.

Alternatively, where an extra measure of corrosion resistance is required, such post-treatment of the coated and hydrogen relief-baked titanium article may comprise a supplementary chromate treatment, whereby a chromium conversion coating is obtained thereon.

It is noted that the titanium article is suitably rinsed between method steps, where appropriate, in a manner known to those skilled in the art.

It will be appreciated that the nickel strike acts as an intermediary between the titanium substrate and the zinc layer electrodeposited thereon, whereby greater adhesion of the zinc layer to the titanium substrate is achieved by preventing the formation of oxides on the titanium substrate prior to the electrodeposition of the zinc layer thereon.

Moreover, the precise and uniform rate of deposition of the nickel and zinc layers on the titanium article ensures a uniform coating over the entire article, including the threaded portions thereof where the article comprises a threaded fastener. The uniform coating thickness generated by the method of the instant invention, for example, provides more consistent prevailing torque when using a self-locking nut on a titanium fastener coated in accordance therewith.

Additionally, it is noted that a further benefit of the coating of the instant invention is a reduction in the frictional resistance encountered during press-fitting of a thus coated titanium fastener in an aluminum bore, in comparison with fasteners employing an aluminum-pigmented coating. The superior lubricity generated by the method of the instant invention, for example, improves the action of a nut on the surface of a threaded titanium fastener coated in accordance therewith, whereby the outer zinc layer is less likely to be damaged during the assembly thereof.

EXAMPLE

Figure 2:
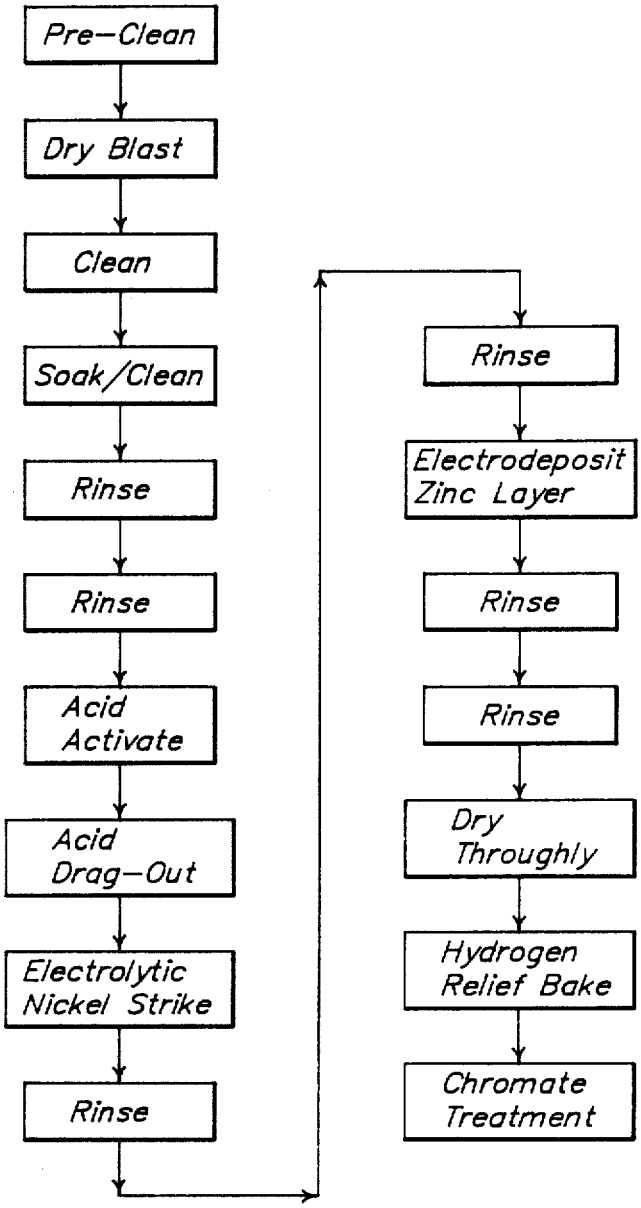
FIG. 2 is a block diagram illustrating the preferred method for practicing the instant invention as regards the plating of a titanium fastener.

The preferred method for practicing the instant invention as regards the plating of a titanium fastener is illustrated in block diagram form in FIG. 2. The titanium fastener is first prepared for plating by conventional cleaning methods known to those skilled in the art, e.g., pre-cleaning by descaling the surface thereof in a caustic fused salt bath; tap water rinsing: barrel tumbling in an alkaline bath; tap water rinsing: thoroughly drying the fastener in a centrifuge dryer operating at a temperature between room temperature and 150° F.; dry grit blasting with 100 mesh aluminum oxide particles to clean and abrade the surface to a matte finish: compressed air cleaning to remove excess grit: and treatment in a suitable alkaline soak cleaner, such as is sold by Diversay-Wyandotte Corporation under the trademark "NUVAT", in the manner recommended by the manufacturer, e.g., soaking in "NUVAT" at a preferred concentration in the range of about 6–8 oz/gal. in water maintained at a temperature of between about 140–160° F., for perhaps about five minutes time.

After cleaning, the titanium fastener is twice rinsed in tap water while being barrel tumbled, each rinse lasting for a period of between about 30 seconds to 1 minute.

The cleaned and rinsed titanium fastener is then immersed and barrel tumbled in a room temperature acid activation bath comprising about 50 percent by volume of HCl (20° Bé) for a period of between about 30 seconds to 1 minute.

The titanium fastener is thereafter barrel tumbled for 5 to 15 seconds in an acid drag-out bath comprising about 5 percent by volume of HCl (20° Bé).

The thus activated surface of the titanium fastener is then coated with a thin nickel base coat by means of a nickel strike applied from a dilute acid bath at room temperature comprising about 42 oz/gal of $NiCl_2$, and about 1.6 percent by volume of HCl, and utilizing a plating grade nickel anode and a cathodic current density of about 15 a.s.f at a solution potential of about 10 volts DC. Preferably, the aqueous nickel bath comprises no more than 0.3 g/1 of $Fe3+$. The bath is agitated as by barrel tumbling during the nickel strike, which typically lasts perhaps 30 to 45 minutes for an internally threaded fastener, and perhaps 6 minutes for an externally threaded fastener, whereby a nickel strike of approximately 0.0001 inches is obtained thereon.

It is noted that, when coating female-type threaded fasteners, the current density utilized during the nickel strike should not exceed 15 a.s.f. since, in addition to the rough and nodular nickel strike which typically results from the use of a current density above 15 a.s.f., the strike would fail to fully coat the internal threads of such fasteners.

Again, the thus nickel-plated titanium fastener is twice rinsed in tap water at room temperature while being barrel tumbled, each rinse lasting for a period of between about 30 seconds to 1 minute.

A zinc layer of a desired thickness is then electrodeposited over the nickel strike by first immersing the nickel-plated titanium fastener in an alkaline aqueous zinc bath at room temperature comprising 3.0 oz/gal of ZnO (hence, about 2.4 oz/gal of Zn metal): 6.0 oz/gal of plating grade NaCN; 10.5 oz/gal of NaOH; 2.5 oz/- gal. of $Na_2CO_3$; 4 ml/gal of a cyanide zinc plate brightener such as McGean/Rohco "DUOZINC 107"; and deionized water. The zinc layer of the desired thickness is thereafter cathodically applied from the bath utilizing a plating grade zinc anode and a cathodic current density of about 12 a.s.f. at a solution potential of about 5 volts DC.

After twice rinsing once again in tap water at room temperature with the aid of barrel tumbling, with each rinse cycle lasting between 30 and 60 seconds, the thus coated titanium fastener is thoroughly dried in a centrifuge dryer operating at perhaps 150° F.

The coated titanium fastener is thereafter immediately subjected to a hydrogen relief bake, e.g., baked at 375° F. for a minimum of 3 hours.

In order to obtain a bright surface finish, the thus coated titanium fastener is dipped for perhaps 10 seconds in a sodium cyanide solution comprising from about 3 to 5 ounces of NaCN per gallon of water.

Alternatively, if a chromium conversion coating is desired over the zinc outer layer of the titanium fastener, an acid chromate solution comprising, for example, sodium dichromate, is applied thereto.

While the preferred embodiment of the invention has been disclosed, it should be appreciated that the invention is susceptible of modification without departing from the spirit of the invention or the scope of the subjoined claims.

I claim:

1. A method for electrodepositing a multilayered coating on a titanium substrate comprising the steps of:

(a) cleaning the substrate, whereby oxides and surface contaminants are removed therefrom;

(b) activating the clean substrate in an agitated bath comprising about 40 to 60 percent by volume 20° Bé hydrochloric acid for a short period, said activating bath being maintained substantially at room temperature;

(c) cathodically coating the substrate with a nickel base coat by means of a nickel strike in an agitated aqueous nickel bath at room temperature; and (d) cathodically depositing a zinc layer of a desired thickness on the nickel base coat from an alkaline aqueous bath maintained at a temperature no greater than 100° F.

2. The method of claim 1 wherein the agitated aqueous nickel bath comprises nickel chloride in the range from about 38 to 42 oz/gal. of solution and hydrochloric acid in a concentration range of about 1 to 2 percent by volume.

3. The method of claim 2 wherein said step of cathodically coating the substrate with a nickel base coat employs a cathodic current density of between about 10 and 15 a.s.f. at a solution potential ranging from about 9 to 11 volts.

4. The method of claim 1 wherein the alkaline aqueous bath comprises zinc oxide and sodium cyanide so as to provide a ratio of cyanide to zinc metal ranging from about 2.4 to 2.7, and wherein a current density of between about 10 and 13 a.s.f. is utilized during the cathodic deposition of the zinc layer.

5. The method of claim 4 wherein the alkaline aqueous bath further comprises sodium hydroxide in the range of about 10 to 12 oz/gal. of solution and a maximum sodium carbonate content of about 5 oz/gal. of solution.

6. A method for coating an article formed primarily of titanium comprising the steps of:

(a) cleaning the article, whereby oxides and surface contaminants are removed therefrom;

(b) activating a surface of the article in an acid bath at room temperature;

(c) immersing the article in an agitated aqueous bath comprising about 1 to 2 percent by volume of hydrochloric acid and nickel chloride in the range of from about 38 to 42 oz/gal. of solution;

(d) cathodically applying a thin nickel base coat on the article utilizing a cathodic current density of between about 10 and 15 a.s.f. at a solution potential ranging from about 9 to 11 volts D.C.;

(e) immersing the nickel-plated article in an agitated alkaline aqueous bath comprising zinc metal in the range of about 2.0 to 2.5 oz/gal.; and (f) cathodically applying a zinc layer of a desired thickness on the nickel-plated article utilizing a cathodic current density of between about 10 and 13 a.s.f. at a solution potential ranging from about 4 to 6 volts D.C.;

whereby the thin nickel base coat improves adhesion of the zinc layer to the article.

7. The method according to claim 6 wherein the acid activating bath of step (b) thereof comprises about 40 to 60 percent by volume 20° Bé hydrochloric acid.

8. The method according to claim 6 wherein the agitated alkaline aqueous zinc bath is maintained at a temperature of no greater than about 100° F.

9. The method according to claim 8 wherein the agitated alkaline aqueous zinc bath of step (e) further comprises cyanide, whereby the ratio of cyanide to zinc metal ranges from about 2.4 to 2.7.

10. The method according to claim 6 including the step of hydrogen relief baking the article subsequent to the cathodic application of the zinc layer thereupon.

11. The method according to claim 10 including the step of brightening the zinc layer on the article subsequent to the hydrogen relief baking thereof by dipping the coated article into a solution comprising sodium cyanide.

12. The method according to claim 11 including the step of applying a chromate acid solution to the zinc layer on the article subsequent to the hydrogen relief baking thereof, whereby a chromate conversion coating is formed thereon.

* * * * *